US007190311B2

(12) United States Patent
Dawson et al.

(10) Patent No.: US 7,190,311 B2
(45) Date of Patent: Mar. 13, 2007

(54) ALIGNMENT CAM FOR NON-CIRCULAR RETRACTABLE ANTENNA

(75) Inventors: Michael P. Dawson, Sunrise, FL (US); David I. Blatt, Margate, FL (US); Brian T. Fein, Sunrise, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/885,193

(22) Filed: Jul. 6, 2004

(65) Prior Publication Data

US 2006/0007047 A1 Jan. 12, 2006

(51) Int. Cl.
*H01Q 1/24* (2006.01)
*H01Q 1/12* (2006.01)
*H01Q 9/30* (2006.01)

(52) U.S. Cl. ..... 343/702; 343/878; 343/900

(58) Field of Classification Search ..... 343/702, 343/718, 872, 880–883, 888, 889, 900, 901
See application file for complete search history.

(56) References Cited

U.S. PATENT DOCUMENTS 5,484,446 A 1/1996 Burke et al. ..... 606/87
5,683,396 A 11/1997 Tokish et al. ..... 606/87
5,764,191 A * 6/1998 Tsuda ..... 343/702
5,945,953 A * 8/1999 Tsuda et al. ..... 343/702
5,969,683 A * 10/1999 Hayes et al. ..... 343/702
6,078,291 A * 6/2000 Paulick et al. ..... 343/702
6,285,340 B1 * 9/2001 Park et al. ..... 343/895
6,608,606 B1 * 8/2003 Chang ..... 343/900
2004/0227676 A1 * 11/2004 Kim et al. ..... 343/702

FOREIGN PATENT DOCUMENTS

JP 2000349522 A * 12/2000

* cited by examiner

*Primary Examiner*—Don Wong
*Assistant Examiner*—Marie Antoinette Cabucos

(57) ABSTRACT

A retractable antenna (100) is provided that includes a body (106) having an orifice (204), a whip (104) retractably coupled to the body (106), at least one follower (200) disposed about the whip (104), and a cam (202) disposed about the orifice (204). The cam (202) is shaped such that the at least one follower (200) interacts with the cam (202) during retraction of the whip (104) so as to rotate the whip as necessary to align the whip in a rotational position that allows full retraction of the antenna. Also provided are an electronic communication device (102) that includes at least one such non-circular retractable antenna (100), and an alignment system for rotationally aligning an extendable portion of a non-circular retractable antenna (100) during retraction.

20 Claims, 5 Drawing Sheets

- PRIOR ART -

- PRIOR ART -

ALIGNMENT CAM FOR NON-CIRCULAR RETRACTABLE ANTENNA

FIELD OF THE INVENTION

The present invention generally relates to the field of retractable antennas, and more particularly to cams for aligning the extendable portion of a non-circular retractable antenna during retraction.

BACKGROUND OF THE INVENTION

Electronic communication devices are widely used for business and personal activities and are continually increasing in popularity. Advances in electronics and wireless communication technology, as well as the development of communication infrastructure, have fueled this increase in popularity and have greatly expanded the capabilities of wireless communication. A wide variety of newer and ever more sophisticated electronic communication devices are continually being introduced by manufacturers, including such devices as wireless phones (e.g., cellular phones), two-way radios (e.g., "walkie-talkies"), pagers and text messaging devices, portable and handheld computers, personal digital assistants (PDAs), satellite communication devices such as global positioning systems (GPSs), and satellite radios, as well as portable televisions, radios, and other entertainment devices.

Electronic communication devices typically have one or more antennas for signal reception and transmission. Several different types of antennas exist, including retractable antennas and fixed antennas. The use of a retractable antenna provides the user with a selectively longer or shorter antenna. A conventional retractable antenna for a wireless communication device is typically formed of a narrower extendable portion that includes a whip and cap, and a wider fixed portion (known as a body or stubby). In contrast, a fixed antenna has only a fixed part.

Consumers often prefer retractable antennas that can be extended when in use to increase reception and transmission efficiency, and retracted when not in use to protect the antenna from damage and reduce the overall size of the communication device so that the device can be easily stored.

The increase in the number of products on the market has lead to increasing competition between manufacturers, and emphasized the need for manufacturers to develop and implement product designs which differentiate their products from competing products in order to gain a competitive edge, attract new consumers, and to persuade existing consumers to upgrade to newer models. The design of the antenna of a wireless communication device is based on functional considerations, but also aesthetic considerations because the antenna typically makes a prominent contribution to the external appearance of the device.

Most retractable antennas are circular antennas that have a cylindrical whip topped by a cylindrical or circular cap so that the extendable portion appears circular in shape when viewed along its longitudinal axis. However, to differentiate its products functionally or aesthetically, a manufacturer can use a non-circular antenna that has a non-cylindrical whip and/or a cap with a radially non-symmetrical shape. Such non-circular retractable antennas may be desirable to consumers for a variety of reasons. For example, compared with circular antennas, a non-circular antenna may be more aesthetically interesting or pleasing, may be more easily handled during extension and retraction, may be less cumbersome when extended, and may be better integrated with the body of the device when retracted. Furthermore, from the manufacturer's perspective, a non-circular retractable antenna provides additional style options in the design of a new electronic communication device.

However, implementing a non-circular retractable antenna that is capable of extending and retracting in a smooth, quick, and efficient manner presents design challenges. For example, while a circular retractable antenna can be retracted at any angle of rotation, a non-circular retractable antenna typically must be aligned at some specific angle of rotation in order to fully retract. The extendable portion of a non-circular retractable antenna will not readily self-align to the proper angle of rotation, and any misalignment blocks the extendable portion from quickly and easily being fully retracted. If the antenna is not fully retracted due to misalignment, there is an increase in the likelihood of the antenna being becoming snagged on an external object, which can cause damage to the antenna or even loss of the device. Further, any difficulty in quickly and easily fully retracting the antenna can cause user frustration by making the communication device difficult to stow away.

Therefore a need exists to overcome the problems with the prior art as discussed above.

SUMMARY OF THE INVENTION

Briefly, in accordance with one aspect of the present invention, there is provided a retractable antenna that includes a body having an orifice, a whip retractably coupled to the body, at least one follower disposed about the whip, and a cam disposed about the orifice. The cam is shaped such that the at least one follower interacts with the cam during retraction of the whip so as to rotate the whip as necessary to align the whip in a rotational position that allows full retraction of the antenna.

In accordance with another aspect of the present invention, there is provided an electronic communication device that includes a device body, and at least one non-circular retractable antenna fixedly coupled to the device body. The non-circular retractable antenna includes an antenna body having an orifice, a whip retractably coupled to the antenna body, at least one follower disposed about the whip, and a cam disposed about the orifice. The cam is shaped such that the at least one follower interacts with the cam during retraction of the whip so as to rotate the whip as necessary to align the whip in a rotational position that allows full retraction of the antenna.

In accordance with yet another aspect of the present invention, there is provided an alignment system for rotationally aligning an extendable portion of a non-circular retractable antenna during retraction. The alignment system includes at least one follower, and a cam that interacts with the at least one follower during retraction. The cam is shaped so as to cause the extendable portion of the antenna to rotate as necessary so as to be forced into a rotational position that allows full retraction of the antenna.

DETAILED DESCRIPTION

The present invention, according to one embodiment, overcomes problems with the prior art by providing a mechanism for the extendable portion of a non-circular retractable antenna to automatically self-align during retraction to the proper rotational orientation needed to fully retract. This enables the user to retract the extendable portion into the fully retracted position in a smooth, quick, and easy manner, and prevents the user from incorrectly retracting the extendable portion into a misaligned position.

More specifically, in this exemplary embodiment, the retractable antenna includes follower features disposed about the whip of the antenna, and a cam feature disposed about the body of the antenna. The interaction of the follower and cam features during retraction of the extendable portion causes the whip to be rotated along its axis as necessary to arrive at the angle of rotation (interchangeably referred to as "rotational position", "orientation", or "rotational orientation") at which the shape of the extendable portion is aligned with the shape of the body. This enables the extendable portion to fully retract into the body. Thus, the mechanical actuation of the follower and cam interaction operates to translate linear motion into the proper rotational alignment.

Figure 19:
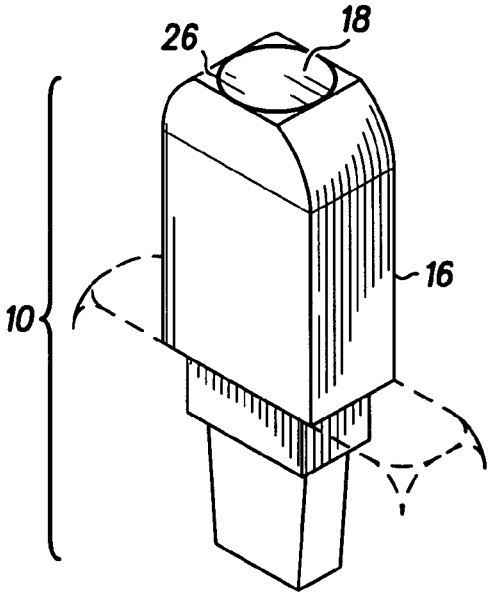
FIGS. 19 and 20 illustrate a conventional circular retractable antenna.
Figure 20:
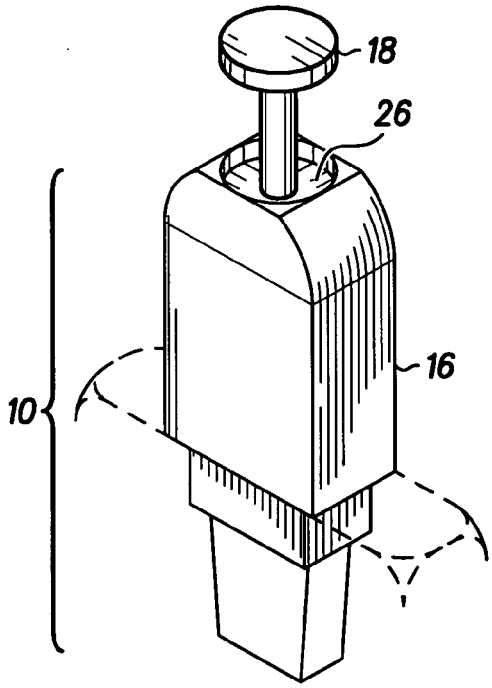

FIGS. 19 and 20 illustrate a conventional circular retractable antenna. FIG. 19 shows the antenna 10 in the retracted position in which the whip 14 and cap 18 are fully retracted into the body 16 such that the cap 18 is engaged with the cap receptacle 26. FIG. 20 shows the antenna 10 in the extended position in which the whip 14 and the cap 18 are extended out from the body 16. Because the whip 14 of such a circular retractable antenna has a cylindrical form and the cap 18 has a circular shape, the extendable portion can be fully retracted at any angle of rotation. In other words, the whip 14, the cap 18, and the cap receptacle 26 are each radially symmetrical throughout 360 degrees, so their shapes are always aligned and therefore always fit together regardless of their relative rotational positions.

Figure 1:
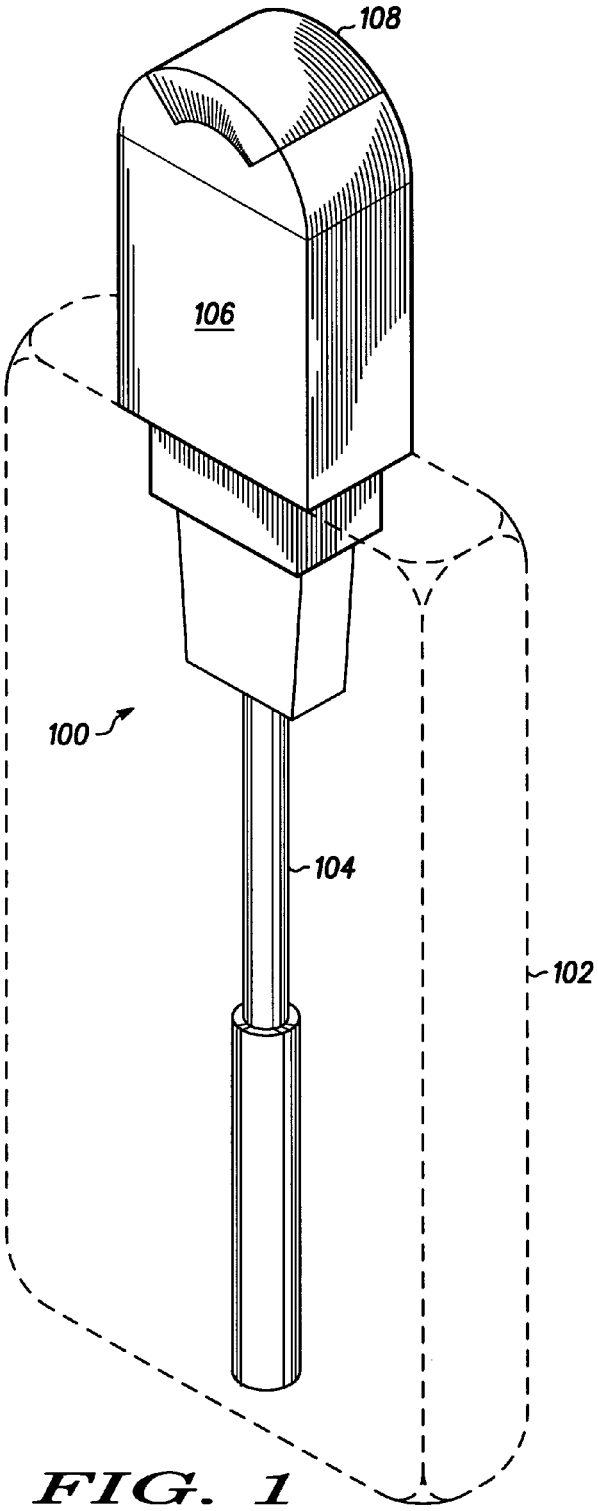
FIG. 1 is a diagram of a non-circular retractable antenna according to one embodiment of the present invention with the antenna fully retracted.

FIG. 1 shows a non-circular retractable antenna according to one embodiment of the present invention. The antenna 100 is a component of an electronic communication device 102, and includes a whip 104, a body 106 (or stubby), and a cap 108. The antenna 100 of this embodiment is a non-circular antenna because the cap 108 on the whip 104 is not radially symmetrical in shape. In FIG. 1, the antenna 100 is in the fully retracted position in which the whip 104 and the cap 108, which is integral with or attached to the whip, are fully retracted into the body 106. The antenna 100 is extended and retracted by extending and retracting the whip 104 so that the cap 108 moves away from or toward the body 106, respectively.

Figure 2:
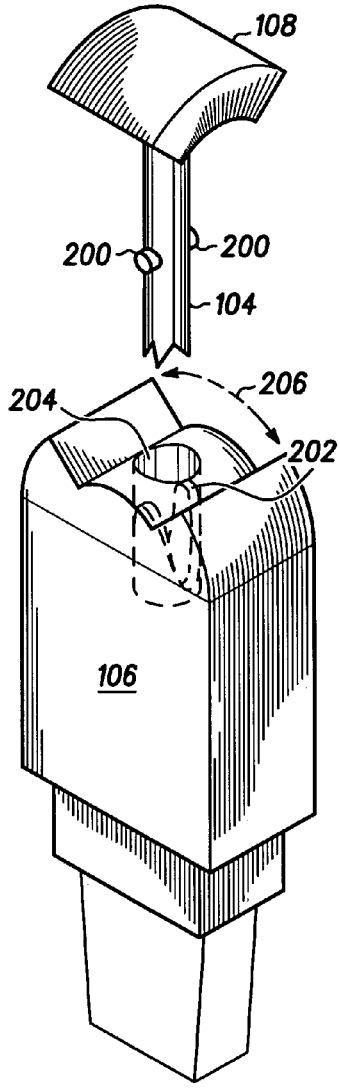
FIG. 2 is a diagram of the non-circular retractable antenna of FIG. 1 with the antenna extended.

FIG. 2 shows the antenna of FIG. 1 in an extended position, with only a portion of the whip shown so that the whip appears separated from the body. FIG. 2 also shows followers 200 located on the whip 104 and a cam 202 disposed in an orifice 204 of the body 106. The whip 104 inserts through the orifice 204, and moves back and forth through the orifice 204 when retracted and extended. When the whip 104 is retracted to a certain point, the followers 200 on the whip 104 come into contact with the cam 202 so as to create an interaction between these features. The interaction of the followers 200 with the cam 202 causes the whip 104 and the cap 108 (i.e., the extendable portion) to rotate. FIG. 2 further illustrates a cap receptacle 206 located at the top of the body 106 adjacent the top of the orifice 204. The cap 108 engages the cap receptacle 206 so that they fit together, with or without making contact, when the extendable portion is fully retracted.

The shape of the cap 108 and the shape of the cap receptacle 206 are complementary to each other (i.e., the shapes conform) so that the cap 108 and the cap receptacle 206 fit together. For the non-circular antenna of this embodiment with its non-circular cap, the cap 108 must be aligned with the cap receptacle 206 at some specific angle of rotation to achieve an aligned position in which they properly fit together so as to allow the antenna 100 to be fully retracted. In contrast, the circular antenna of FIGS. 19 and 20 with its circular cap and cap receptacle could be fully retracted at any angle of rotation because their circular shapes are always aligned no matter what their relative angles of rotation. In embodiments of the present invention, the followers 200 and the cam 202 cause the whip 104 to rotate as necessary during retraction to properly align the cap 108 with the cap receptacle 206 so as to always allow full retraction of the extendable portion. Without the cam and follower features of the present invention, if the cap of the non-circular antenna was misaligned with the cap receptacle, the antenna would be prevented from fully retracting until the extendable portion was manually rotated to an angle of rotation (i.e., aligned position) that properly aligns the cap 108 with the cap receptacle 206.

Figure 3:
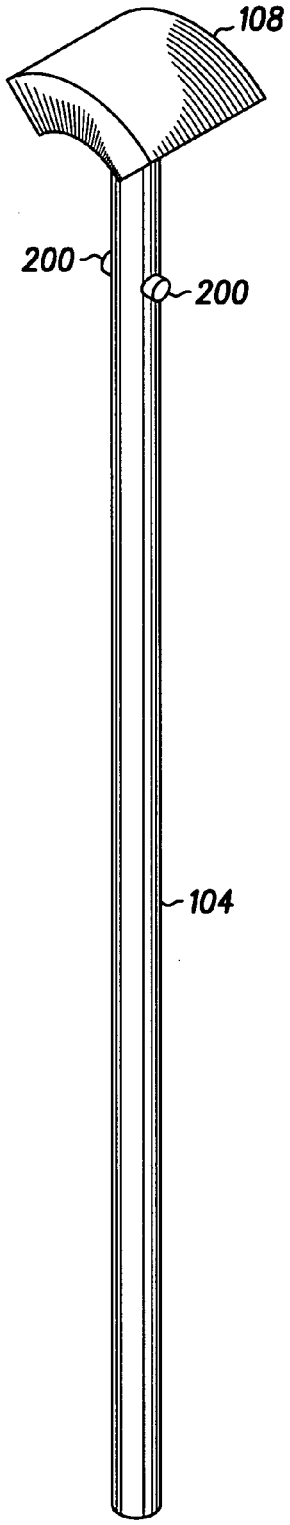
FIGS. 3–6 illustrate various views of the extendable portion of the non-circular retractable antenna of FIG. 1.
Figure 6:
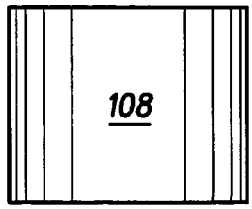
Figure 4:
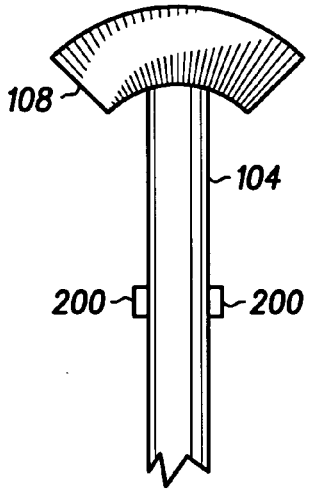
Figure 5:
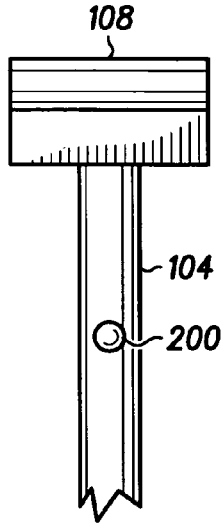

FIGS. 3–6 illustrate various views of the extendable portion of the non-circular retractable antenna of FIG. 1. FIG. 3 shows an isometric view, FIG. 4 shows a front view, FIG. 5 shows a side view, and FIG. 6 shows a top view. These views show the shapes and locations of the whip 104, the cap 108, and the followers 200 in this embodiment.

Figure 7:
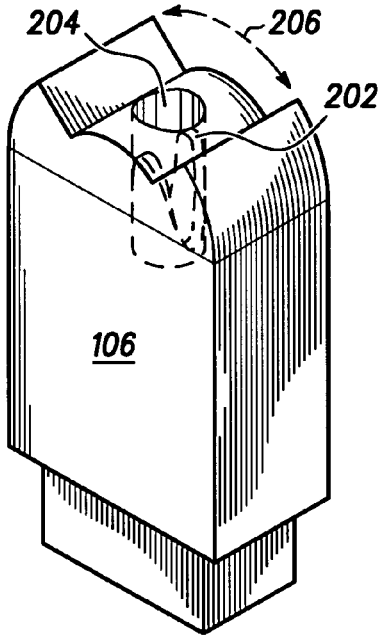
FIGS. 7–10 illustrate various views of the fixed portion of the non-circular retractable antenna of FIG. 1.
Figure 8:
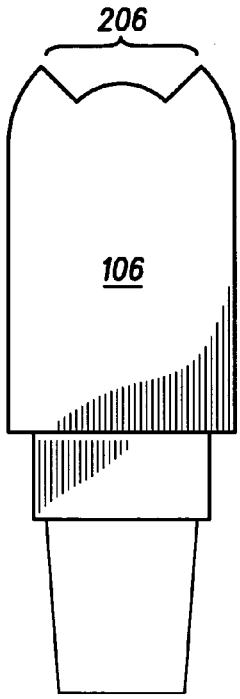
Figure 9:
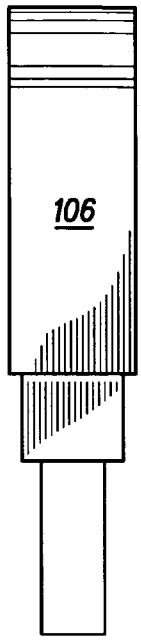
Figure 10:
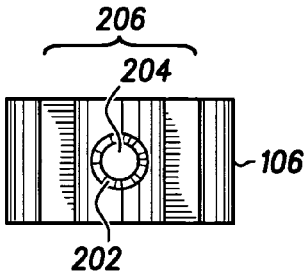

FIGS. 7–10 illustrate various views of the fixed portion of the non-circular retractable antenna of FIG. 1. FIG. 7 shows an isometric view, FIG. 8 shows a front view, FIG. 9 shows a side view, and FIG. 10 shows a top view. These views show the shapes and locations of the orifice 204, the cam 202, and the cap receptacle 206 in this embodiment.

Figure 11:
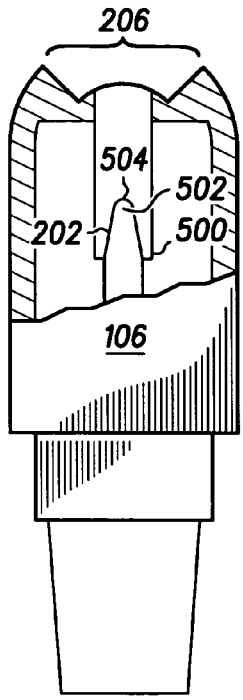
FIG. 11 shows a partial cross-section of the front view of the fixed portion illustrated in FIG. 8.

FIG. 11 shows a partial cross-section of the front view of the fixed portion illustrated in FIG. 8. The partial cross-section illustrated in FIG. 11 shows a portion of the internal structure of the body 106 that includes the cam 202. In this embodiment, the shape of the cam 202 forms two pockets 500 and two apexes 502. Each apex 502 has a peak 504, which is the point of the apex 502 that is closest to the cap receptacle 206. The cam 202 is in the form of a ledge (or protrusion) located on the internal surface of the orifice 204 that is substantially sinusoidal in shape (i.e., has alternating peaks and valleys). This sinusoidal shape of the ledge forms the pockets 500 and the apexes 502 such that the 360 degree circumference of the internal surface of the orifice 204 has alternating pockets and apexes, for example, every 90 degrees.

In other words, the cam 202 can be a shaped ledge that is closest to the cap receptacle 206 at two opposing internal points of the orifice 204, and is farthest away from the cap receptacle 206 on two other opposing internal points of the orifice 204. The pockets 500 are formed where the cam 202 is farthest away from the cap receptacle 206, and the apexes 502 are formed where the cam 202 is closest to the cap receptacle 206. In this embodiment, the pockets 500 and the apexes 502 are each rounded in shape, with the cam 202 sloping at a varying angle between a pocket 500 and an apex 502 (i.e., they substantially conform to the shape of a sinusoidal wave). In the view of the extendable portion shown in FIG. 11, a front view of one apex 502 is shown with the two pockets 500 shown on the opposing sides. The second apex 502 is not visible because it is located on the back side of the body 106.

Figure 12:
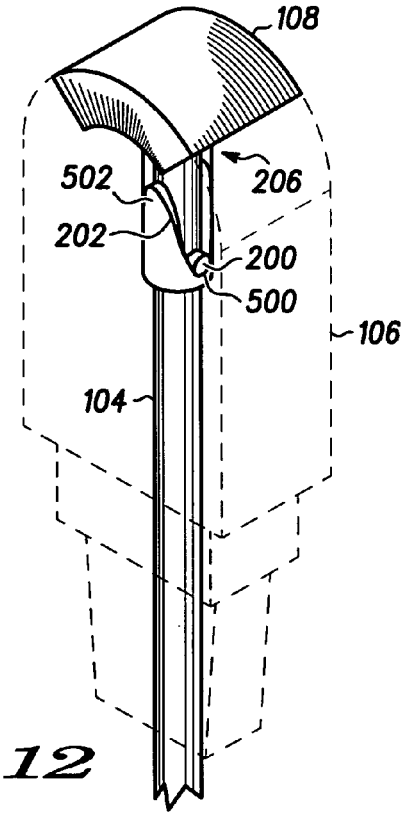
FIG. 12 is an outline diagram showing an isometric view of the antenna of FIG. 1 with the antenna fully retracted.

FIG. 12 is an outline diagram showing an isometric view that illustrates the internal and external structure of the antenna of FIG. 1. In FIG. 12, the extendable portion (i.e., whip 104 and cap 108) is fully retracted into the body 106. Thus, the cap 108 is engaged within the cap receptacle 206. In this fully retracted position, the followers 200 sit in the pockets 500 of the cam 202.

With such a structure for the cam and followers, the shape of the cam 202 forces the followers 200 into the pockets 500 as the whip 104 is retracted. More specifically, the retraction of the extendable portion causes the followers 104 to move along the cam and rotate the whip 104 as necessary so as to arrive at an angle of rotation at which the followers 200 sit in the pockets 500. By matching this rotational position with a rotational position necessary for full retraction, the cap 108 is caused to rotationally align with the cap receptacle 206 for proper engagement, and thus full retraction of the extendable portion.

Figure 13:
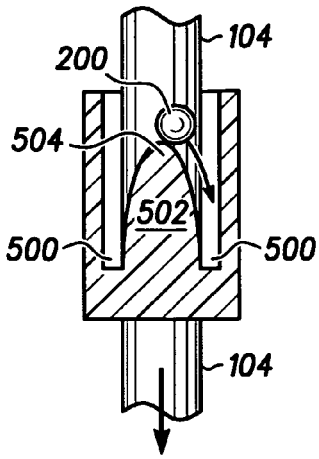
FIGS. 13 through 18 are diagrams illustrating the interaction of the follower and cam features during retraction of the antenna of FIG. 1.
Figure 14:
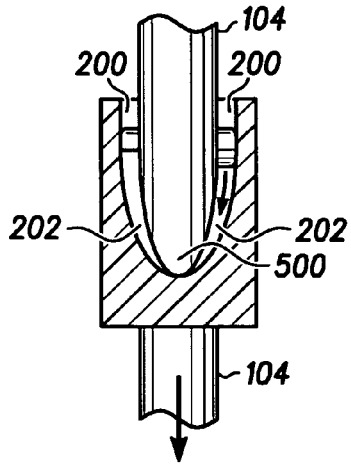
Figure 15:
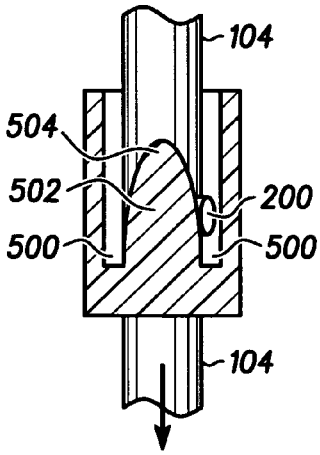
Figure 16:
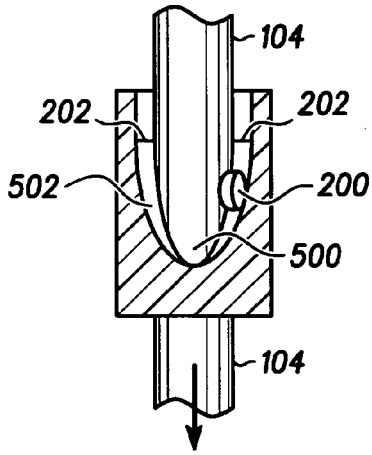
Figure 17:
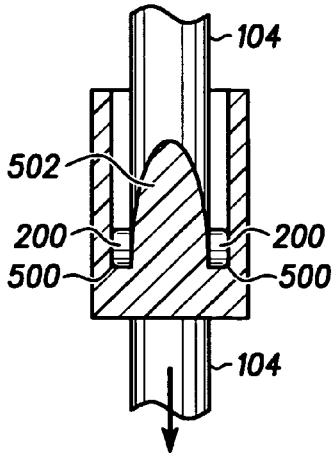
Figure 18:
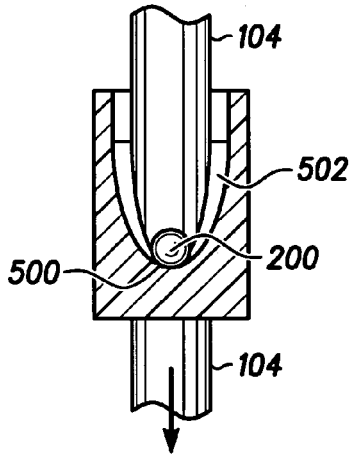

FIGS. 13 through 18 illustrate various stages in this interaction between the followers and cam during retraction of the antenna of FIG. 1. FIGS. 13, 15, and 17 show front views and FIGS. 14, 16, and 18 show corresponding side views of the follower and cam interaction at three different stages as the whip 104 is retracted into the body 106, with the arrows indicating the direction of movement of the whip and the followers during retraction. FIGS. 13 and 14 show an initial stage of the retraction of the misaligned whip when the followers first come into contact with the cam. FIGS. 15 and 16 show an intermediate stage of the retraction when the followers are moving along the cam toward the pockets. FIGS. 17 and 18 show the final stage of the retraction when the followers sit in the pockets (i.e., when the antenna is fully retracted).

During retraction, if the cap 108 is misaligned with the cap receptacle 206, at some point the followers 200 on the whip 104 contact the cam 202 at a position other than the pockets 500 after the whip 104. For example, at the initial stage of the illustrated retraction (FIGS. 13 and 14), the followers 200 contact the cam 202 near the peaks 504 of the apexes 502. As explained above, the cam 202 provides a shaped ledge that wraps around the inner circumference of the orifice 204 in a substantially sinusoidal pattern between the apexes 502 and the pockets 500. After the followers 200 come into contact with the cam 202 near the peaks 504 of the apexes 502, further retraction of the whip 104 causes the followers 200 to slide along the cam 202 in a downward direction toward the pockets 500 (FIGS. 15 and 16). This rotates the whip 104. The followers 200 continue to follow the contours of the cam 202 as the whip 104 is retracted until the followers 200 sit in the pockets 500 (FIGS. 17 and 18). At this point, the followers 200 prevent the whip 104 from being retracted any further.

The interaction of the followers 200 and the cam 202 during retraction translates the downward motion of the whip 104 into rotational motion, so as to cause the whip 104 to rotate until the followers 200 reach the lowest point on the cam 202 (i.e., the pockets 500). The rotational position of the whip 104 at which the followers 200 sit in the pockets 500 is designed to correspond to the rotational position at which the cap 108 is engaged within the cap receptacle 206. In other words, the interaction of the followers on the whip and the cam in the orifice in the body causes the followers to move toward and into the pockets, and this acts to align the non-circular cap 108 with the correspondingly-shaped cap receptacle 206. Thus, the extendable portion is automatically forced into an aligned position that allows the antenna to be fully retracted (i.e., the extendable portion to be fully retracted into the body).

In the retraction described above, the whip is initially in a misaligned rotational position, so the followers come into contact with the cam away from the pockets. In contrast, if the whip is initially in a perfectly aligned position (i.e., a position in which the cap aligns with the cap receptacle), the followers initially contact the cam in the pockets and the whip is not rotated. However, in either case the present invention obviates the need for the user to make a directed effort to insure the proper rotational alignment of the whip before or during retraction. In embodiments of the present invention, no matter what rotational position the whip is initially in, it is automatically self-aligned during retraction to a rotational position that allows fully retraction.

Accordingly, the present invention offers advantages over the prior art. For example, the present invention enables a non-circular retractable antenna to be easily retracted, so as to facilitate ease of use of the electronic communication device. Furthermore, the present invention facilitates full retraction of the whip so as to prevent the whip from not being fully retracted in some cases due to misalignment. This reduces the chance that the antenna will get snagged on an external object (such as clothing and purses), which can damage the antenna or the entire communication device. Moreover, the present invention enables antennas with designer shapes to be implemented without increasing the difficulty of operation or effective lifespan of the communication device. Thus, many additional design options are made practical for manufacturers, so as to allow differentiation of their products and catering to the changing tastes of consumers.

The embodiment of the present invention described above is merely an exemplary embodiment, and it will be appreciated by the skilled artisan that a wide variety of other designs could be implemented within the scope of the present invention. For example, any other design for the cam and followers could be utilized as long as their interaction causes the extendable portion to align to a proper rotational position for full retraction of the antenna. The cam and followers can have other shapes. While two followers are shown in the exemplary embodiment, any number of followers can be utilized. The cam can be disposed about the body at any location, and the followers can be disposed about the whip at any location. In one embodiment, the locations of the cam and followers are reversed (i.e., the followers are disposed about the body, and the cam is disposed about the whip).

Further, in the exemplary embodiment described above in which the cap is substantially rectangular, the cam forms two pockets and two apexes so that its interaction with the followers causes the whip to rotate into one of two rotational positions. However, in further embodiments the cam can form one or more pockets and one or more apexes. For example, for an embodiment in which the cap is shaped as a five-pointed star, the cam can be designed to form five pockets and five apexes so that its interaction with the follower causes the whip to rotate into one of five rotational positions. As another example, the cam can be designed to have only a single pocket that interacts with one or more followers disposed about the whip.

Additionally, the pockets and apexes of the cam can be formed in any shape, and the cam can slope at any angle between a pocket and an apex. For example, in further embodiments, the pockets can have flat bottoms, the apexes can have pointed tops, and/or the cam can slope at a constant angle between a pocket and an apex. Similarly, the whip, the cap, and the body of the antenna can have any shape, and either or both of the whip and the cap can have a non-circular shape. Likewise, in various embodiments, the cap receptacle (if provided) is formed by the fixed portion of the antenna, the body of the device, or a combination of the two. Further, the fixed portion of the antenna can be integral with the body of the device.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

What is claimed is:

1. A retractable antenna comprising:

a body having an orifice;

a whip retractably coupled to the body;

at least one follower disposed about the whip; and a cam disposed about the orifice, the cam being shaped such that the at least one follower interacts with the cam during retraction of the whip so as to rotate the whip as necessary to align the whip in a rotational position that allows full retraction of the antenna.

2. The retractable antenna of claim 1, further comprising:

a cap attached to or integral with the whip; and a cap receptacle disposed about the body, wherein the cap and the cap receptacle have complementary shapes such that the cap and cap receptacle fit together when the whip is in the rotational position and the antenna is fully retracted.

3. The retractable antenna of claim 2, wherein the cap is not radially symmetrical in shape.

4. The retractable antenna of claim 1, wherein the cam comprises a protrusion within the orifice that is substantially sinusoidal in shape.

5. The retractable antenna of claim 1, wherein the cam comprises at least two apexes and at least two pockets.

6. The retractable antenna of claim 5, wherein the at least one follower comprises two followers.

7. The retractable antenna of claim 6, wherein the whip is forced into the rotational position when each of the followers sits in one of the pockets.

8. The retractable antenna of claim 1, wherein the whip is not radially symmetrical in shape.

9. An electronic communication device comprising:

a device body; and at least one non-circular retractable antenna fixedly coupled to the device body, wherein the non-circular retractable antenna includes:

an antenna body having an orifice;

a whip retractably coupled to the antenna body;

at least one follower disposed about the whip; and a cam disposed about the orifice, the cam being shaped such that the at least one follower interacts with the cam during refraction of the whip so as to rotate the whip as necessary to align the whip in a rotational position that allows full retraction of the antenna.

10. The device of claim 9, further comprising:

a cap attached to or integral with the whip of the antenna; and a cap receptacle formed by at least one of the antenna body and the device body, wherein the cap and the cap receptacle have complementary shapes such that the cap and cap receptacle fit together when the whip is in the rotational position and the antenna is fully retracted.

11. The device of claim 10, wherein the cap is not radially symmetrical in shape.

12. The device of claim 9, wherein the cam comprises a protrusion within the orifice that is substantially sinusoidal in shape.

13. The device of claim 9, wherein the cam comprises at least two apexes and at least two pockets.

14. The device of claim 9 wherein the at least one follower comprises two followers.

15. An alignment system for rotationally aligning an extendable portion of a non-circular retractable antenna during retraction, the alignment system comprising:

at least one follower; and a cam that Interacts with the at least one follower during retraction, the cam being shaped so as to cause the extendable portion of the antenna to rotate as necessary so as to be forced into a rotational position that allows full retraction of the antenna.

16. The alignment system of claim 15, wherein the cam comprises a protrusion that is substantially sinusoidal in shape.

17. The alignment system of claim 15, wherein the cam comprises at least two apexes and at least two pockets, and the at least one follower comprises two followers.

18. A non-circular retractable antenna comprising the alignment system of claim 15.

19. The non-circular retractable antenna of claim 18, wherein the extendable portion of the antenna comprises:

a whip; and a non-radially symmetrical cap attached to or integral with the whip, wherein the cap fits together with a cap receptacle when the extendable portion of the antenna is in the rotational position and the antenna is fully retracted.

20. An electronic device comprising at least one non-circular retractable antenna according to claim 18.

* * * * *